US005314063A

United States Patent [19]

Lee et al.

[11] Patent Number: 5,314,063

[45] Date of Patent: May 24, 1994

[54] GOLF BAG HAVING EXTERNAL FRAME

[75] Inventors: R. David Lee, Springfield; Andrew P. Cimini, Nashville, both of Tenn.

[73] Assignee: Professional Bags, Inc., Springfield, Tenn.

[21] Appl. No.: 998,362

[22] Filed: Dec. 29, 1992

[51] Int. Cl.[5] ..... A63B 55/00; A63B 55/10

[52] U.S. Cl. ..... 206/315.7; 206/315.5

[58] Field of Search ..... 206/315.7, 315.8, 315.5, 206/315.3; 248/96

[56] References Cited

U.S. PATENT DOCUMENTS

| | | | |
|---|---|---|---|
| 1,555,772 | 9/1925 | Stripe | 206/315.7 X |
| 1,591,914 | 7/1926 | Farish | 206/315.7 X |
| 1,868,979 | 7/1932 | Hotze | 206/315.3 X |
| 1,926,184 | 9/1933 | Schwer | 206/315.7 X |
| 1,939,488 | 12/1933 | Dent et al. | 206/315.8 |
| 2,079,551 | 5/1937 | Eicholtz | 206/315.8 |
| 2,435,479 | 2/1948 | Thommen | 206/315.8 |
| 2,507,249 | 5/1950 | Dorazio . | |
| 2,661,175 | 12/1953 | Holder | 206/315.7 X |
| 3,465,993 | 9/1969 | Muehlhausen | 206/315.7 X |
| 3,593,766 | 7/1971 | Harmon et al. | 206/315.7 |
| 3,784,138 | 1/1974 | Herling et al. | 248/96 |
| 3,938,719 | 2/1976 | Carlton | 248/96 X |
| 4,798,357 | 1/1989 | Cho | 206/315.7 X |

FOREIGN PATENT DOCUMENTS

| | | | |
|---|---|---|---|
| 3942 | 8/1932 | Australia | 206/315.6 |
| 656978 | 1/1963 | Canada | 248/96 |
| 689509 | 9/1930 | France | 206/315.6 |
| 48391 | 9/1928 | Norway | 224/210 |
| 90308 | 9/1957 | Norway | 224/210 |
| 73214 | 2/1929 | Sweden | 224/210 |
| 213804 | 4/1924 | United Kingdom | 206/315.6 |
| 490263 | 8/1938 | United Kingdom | 224/210 |

*Primary Examiner*—Sue A. Weaver

*Attorney, Agent, or Firm*—Luedeka, Hodges, Neely & Graham

[57] ABSTRACT

The specification discloses a golf bag having an external frame. In a preferred embodiment, the bag includes an elongate body formed of a pliable material, such as nylon, which defines a cavity for receiving golf clubs and a rigid frame positioned external to the cavity to support the body. The frame has V-shaped top and bottom sections connected by an elongate spine. The spine is configured to align with the central axis of the body of the bag and is isolated from the golfer by a garment bag positioned to sandwich the spine between the body and the garment bag.

9 Claims, 5 Drawing Sheets

GOLF BAG HAVING EXTERNAL FRAME

FIELD OF INVENTION

This invention relates generally to golf bags and more particularly to a golf bag having an external frame and a body supported by the frame.

Many golfers prefer to walk rather than to use a motorized golf cart when playing golf. In addition, some golfers who walk also prefer to carry their golf bag and clubs rather than pull them with a pull cart. Conventional golf bags are ill-suited for carrying the length of a golf course. For example, such bags are heavy, cumbersome, and rub against and chafe the golfer when carried.

Accordingly, it is an object of the invention to provide an improved golf bag.

It is another object of the invention to provide a golf bag which is light-weight and more easily carried than conventional golf bags.

A further object of the invention is to provide a golf bag of the character described which has an external frame provided by a substantially rigid material.

Still another object of the present invention is to provide a golf bag of the character described which is uncomplicated in construction.

SUMMARY OF THE INVENTION

Having regard for the above and other objects, the present invention is directed to a golf bag which comprises an elongate body having an exterior, an interior, an open top end, a closed bottom end, a length, a width, and a central longitudinal axis, the body defining a cavity along its interior between the top end and bottom end for receiving a plurality of golf clubs; and a rigid frame supportably associated with the body and positioned adjacent the exterior of the body. The preferred frame has a generally V-shaped top positioned adjacent the top end of the body, a generally V-shaped bottom positioned adjacent to the bottom end of the body, and a spine extending between and connecting the V-shaped top and bottom of the frame and aligned substantially parallel to the length of the body.

BRIEF DESCRIPTION OF THE DRAWINGS

The above and other features and advantages of the invention will be described in further detail in the following specification with reference to the accompanying drawings, in which.

DETAILED DESCRIPTION

Figure 1:
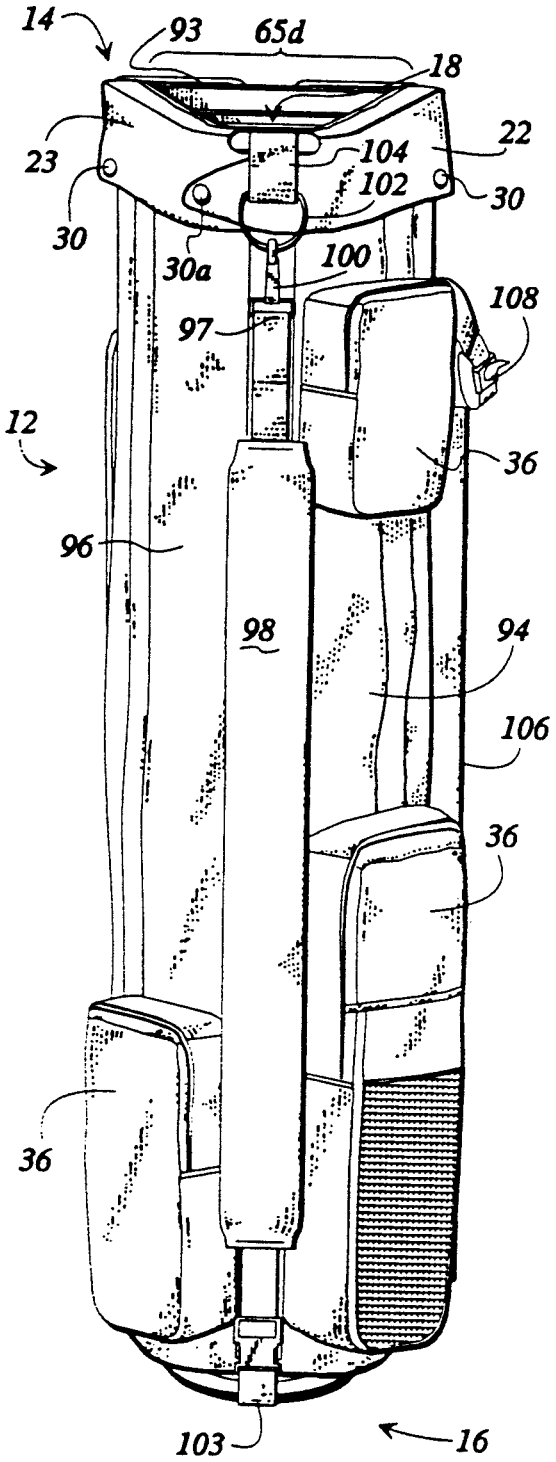
FIG. 1 is a front elevational view of a preferred embodiment of a golf bag having an external frame in accordance with the invention.

With reference now to the drawings in which like reference characters designate like or similar parts throughout the several views, there is shown in FIG. 1 a golf bag 10 illustrating one embodiment of the present invention.

Figure 2:
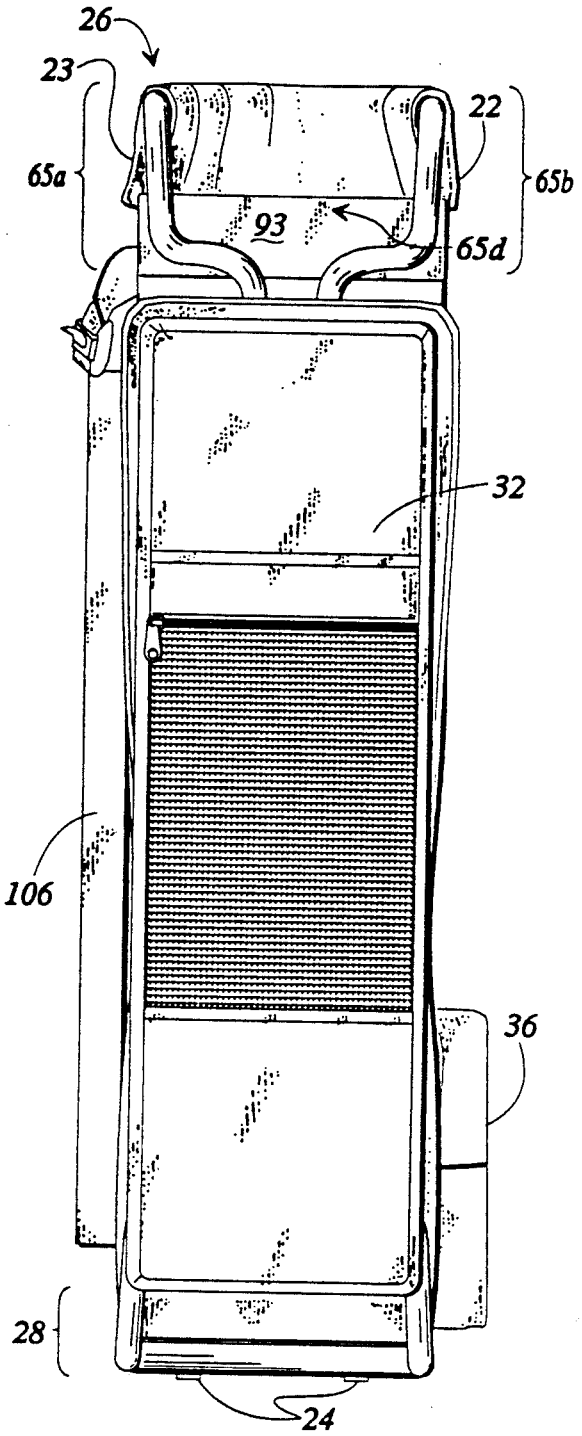
FIG. 2 is a rear plan view of the golf bag of FIG. 1 showing a garment bag hingedly positioned around the frame.
Figure 3:
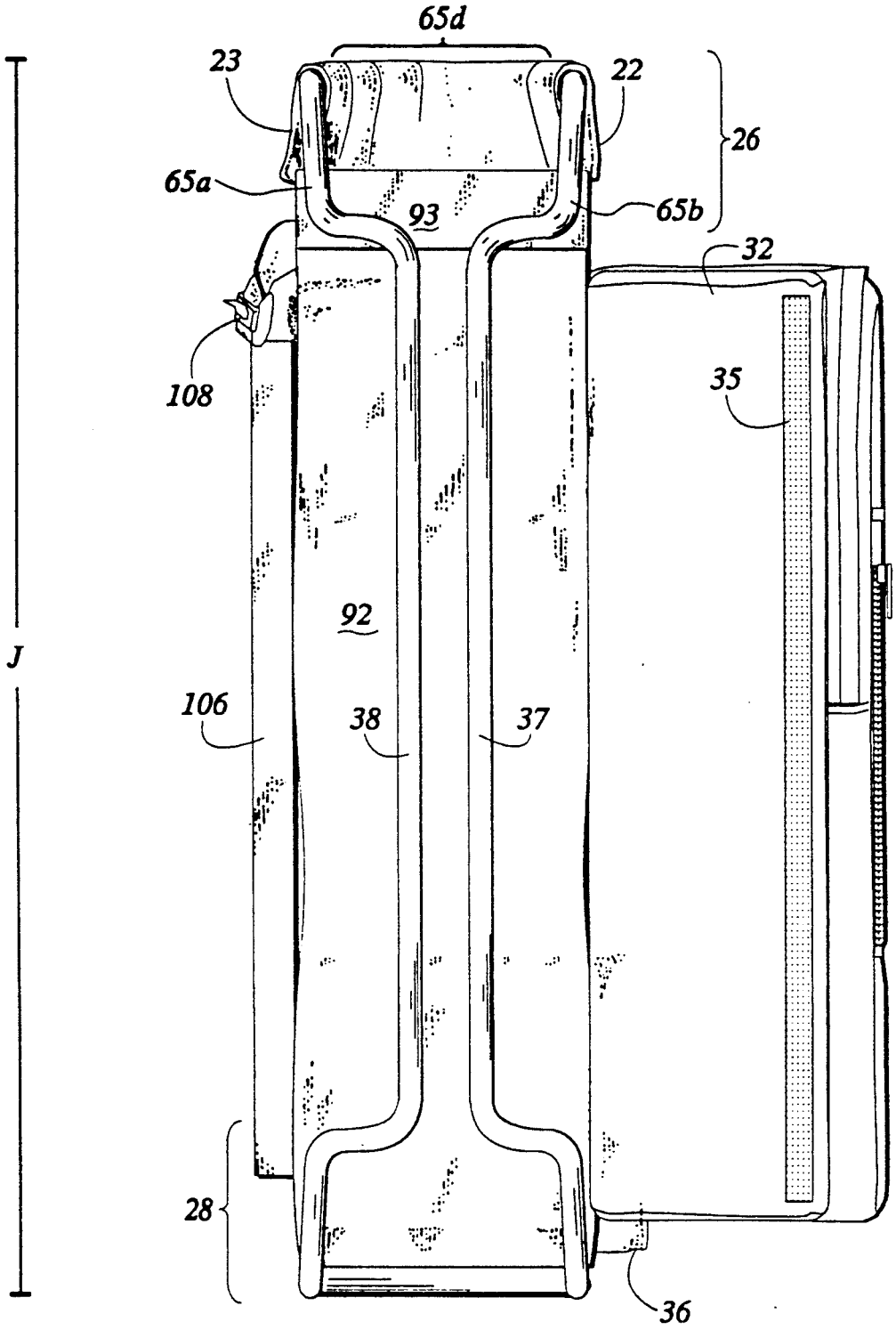
FIG. 3 is a rear plan view as a FIG. 2, but showing the garment bag swung open to reveal the frame.
Figure 4:
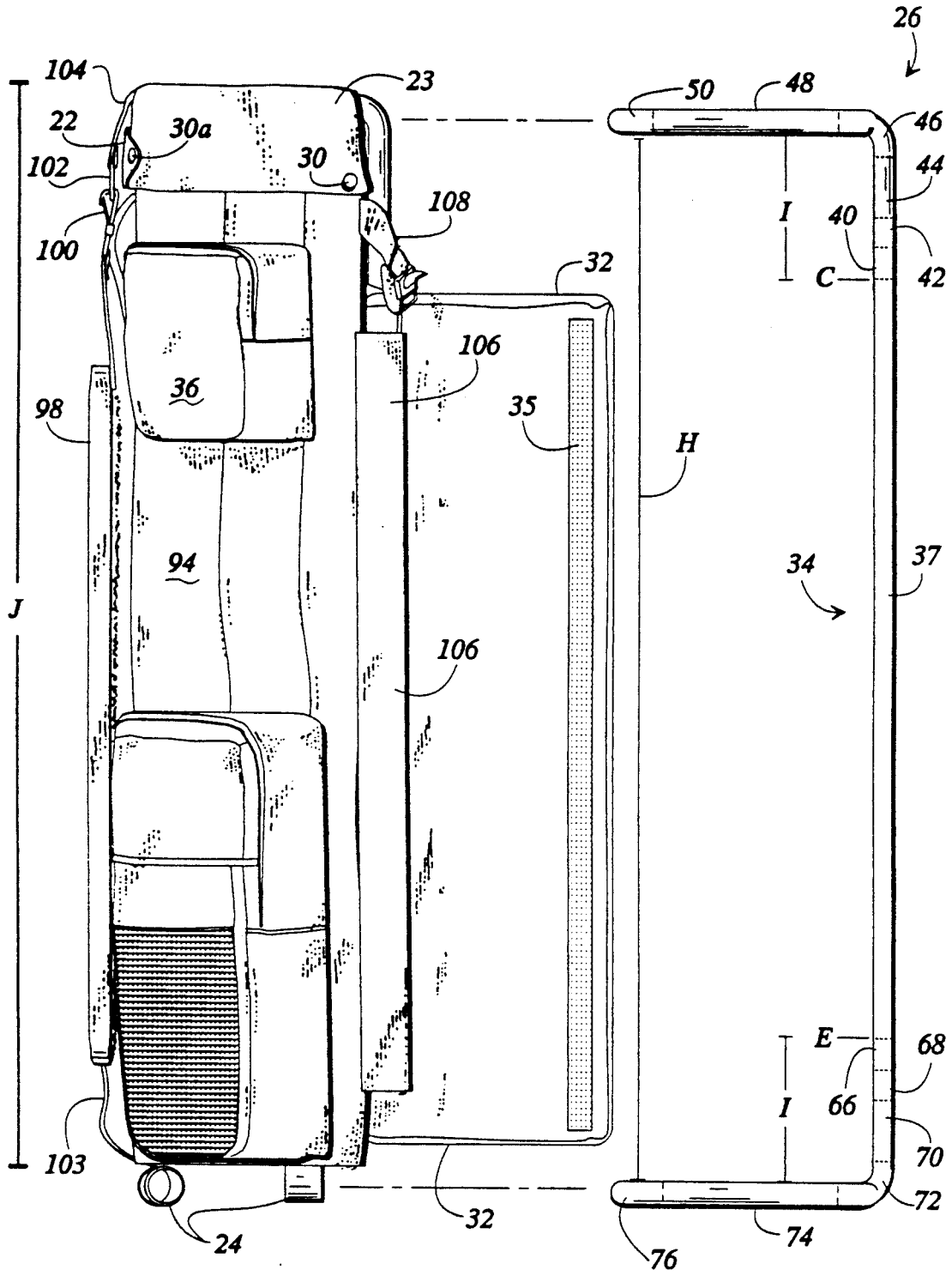
FIG. 4 is an exploded view of the golf bag of FIG. 1.

With additional reference to FIGS. 2, 3, and 4, the golf bag 10 includes an elongate body 12 formed of a durable, light-weight and preferably pliable material, such as rip-stop nylon, having an open top end 14 and a closed bottom end 16. For comfort, padding may be provided within the material. The interior of the body 12 defines a cavity 18, and the open end of the cavity is defined by the top end 14 and the closed end of the cavity is defined by the bottom end 16. The cavity 18 is sized to receive a set of golf clubs and may further include dividers 19 for spacing clubs apart.

The body 12 is supportably attached to a rigid external frame 20 as by top cuffs 22 and 23 located at the top end 14 and by bottom straps 24 located at the bottom end 16. The cuffs 22, 23 encircle and wrap around a curved and generally V-shaped top 26 of the frame and the bottom straps 24 wrap around a curved and generally V-shaped bottom 28 of the frame. The cuffs 22, 23 are formed of the same material as the body and are preferably padded. The cuffs 22, 23 are preferably secured in the wrapped position as by a plurality of mating button snaps 30 or other fasteners provided between the cuffs 22,23 and the body 12 of the bag. In addition, it is preferred that the cuffs are secured to one another by a button snap 30*a* or other fastener, as shown in FIG. 1. The straps 24 are preferably formed of mating hook and loop material so that they are self-securing, it being understood that other fasteners could be used. A secondary body portion in the form of a garment bag 32 is hingedly attached along its length to one side of the body 12 adjacent an elongate spine 34 of the frame 20 and is releasably attached, as by mating hook and loop material 35, to the body on the opposite side of the spine 34. In addition, storage compartments or pockets 36 may be provided at desired locations on the body 12.

Figure 5:
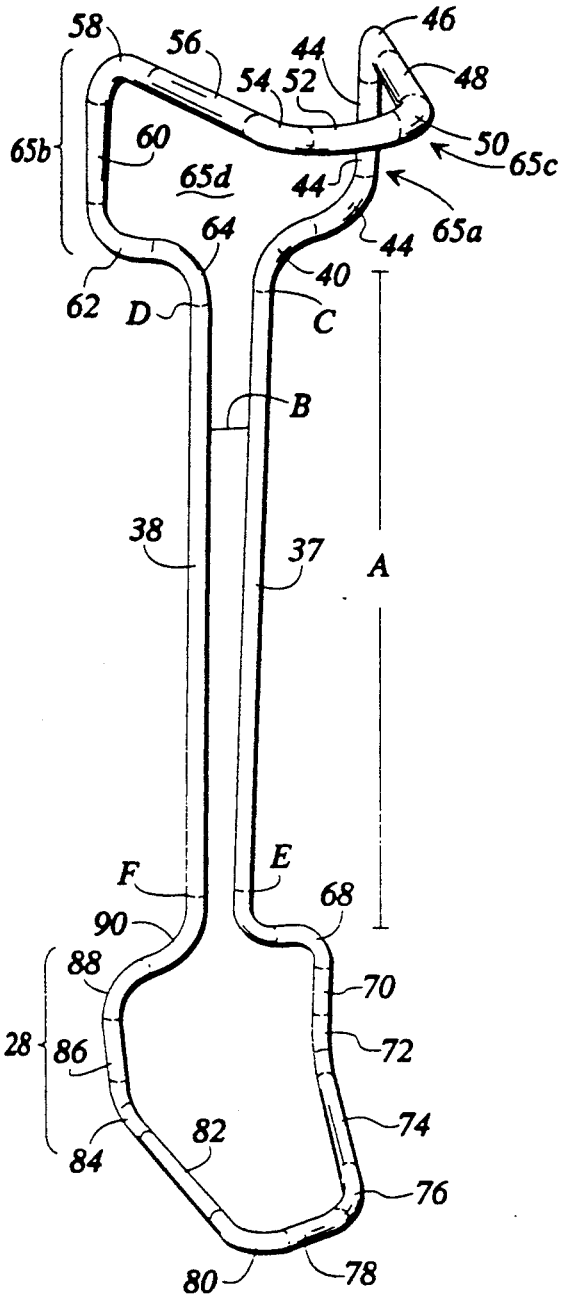
FIG. 5 is a perspective view of the frame.
Figure 6:
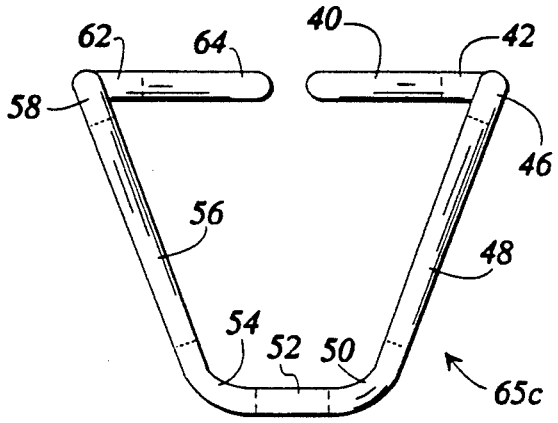
FIG. 6 is a detailed view of the V-shaped top of the frame of FIG. 5.

Referring now to FIGS. 5 and 6, the frame 20 is a continuous loop of a light-weight, rigid material, such as one inch O.D. aluminum tubing, bent at predetermined locations to provide the desired frame configuration. The spine 34 extends between the top 26 and the bottom 28 of the frame and is formed by parallel and spaced apart elongate rod sections 37, 38. Each rod section 37, 38 has a length A of about 21 inches and the rod sections 37, 38 are closely spaced apart from one another a distance B of about one inch.

The upper ends of the rod sections 37, 38 connect to the V-shaped top 26 of the frame at points C and D respectively. The top 26 includes, in order from point C to D and as defined by the dashed lines, elbows 40, 42, elongate section 44, elbow 46, elongate section 48, elbow 50, top section 52, elbow 54, elongate section 56, elbow 58, elongate section 60, and elbows 62, 64 having the dimensions set forth in Table 1.

TABLE 1

| Section | Bend Angle | Length (inches) |
|---|---|---|
| 40 | 90° | 2.0 |
| 42 | 90° | 2.5 |
| 44 | Straight | 3.0 |
| 46 | 90° | 2.5 |
| 48 | Straight | 5.0 |
| 50 | 105° | 2.0 |
| 52 | Straight | 2.0 |
| 54 | 105° | 2.0 |
| 56 | Straight | 5.0 |
| 58 | 90° | 2.5 |

TABLE 1-continued

| Section | Bend Angle | Length (inches) |
|---|---|---|
| 60 | Straight | 3.0 |
| 62 | 90° | 2.5 |
| 64 | 90° | 2.0 |

As can be seen, the V-shaped top 26 can be described in terms of a pair of diverging extension arms 65*a*, 65*b* (provided by elbows 40, 42 and elongate section 44, and elbows 62, 64 and elongate section 60, respectively) and a generally V-shaped curved portion 65*c* provided by elbows 46, 50, 54, 58, elongate sections 48, 56 and top section 52. The extension arms 65*a*, 65*b* diverge laterally away from the spine and provide a "Y" or goalpost type opening 65*d* between the extension arms 65*a*, 65*b* through which golf clubs may be conveniently inserted or removed from the cavity 18. The curved portion 65*c* is disposed in a plane substantially perpendicular to the spine 34 and connected to each of the extension arms 65*a*, 65*b* at the uppermost ends of the extension arms.

The lower ends of the rod sections 37, 38 connect to the V-shaped bottom 28 of the frame at points E and F, respectively. The bottom 28 is identical to the top 26 and includes, in order from point E to F and as defined by the dashed lines, elbows 66, 68, elongate section 70, elbow 72, elongate section 74, elbow 76, bottom section 78, elbow 80, elongate section 82, elbow 84, elongate section 86, and elbows 88, 90.

As stated previously, the rod sections 37, 38 each have a length A of about 21 inches. The top and bottom V-shaped curved sections 26, 28 each extend above the rod sections 37, 38 of the spine a distance I of about 7 inches so that the overall length or height H of the frame, as measured from the upper edge of the top section 52 to the lower edge of the bottom section 78 is about 35 inches.

The body 12 is sized to be supported by the frame 20. Accordingly, the body 12 has an overall length or height J of about 35 inches and the top and bottom ends 26, 28 of the body are sized and shaped to substantially correspond to the top and bottom V-shaped sections 37, 38, respectively. To this end, the body 12 is generally V-shaped and has rear side 92, and lateral sides 94, 96. Side 92 has a width of about 8 inches and a height of about 31 inches so that the when the body is supported by the frame, the side 92 extends upwardly to about half the height of the goalpost shaped opening 65*d* provided between the extension arms 65*a*, 65*b* and is below the curved portion 65*c* of the top.

A bendable stiffener 93 is provided within the uppermost 3 inches of the side 92 so that the upper end of the side 92 is relatively stiff, but bendable. Sides 94, 96 each have a width of about 7 inches and a height of about 35 inches so that the sides 94, 96 extend above the side 92 by about 4 inches. As will be appreciated, golf clubs may be readily passed over the stiffener 93 and through the opening 65*d* for insertion into or removal from the cavity 18. The positioning of the stiffener 93 is advantageous to prevent the shafts of golf clubs from scraping or otherwise contacting the spine and extension arms. This is particularly advantageous when the bag is used with golf clubs having graphite or boron shafts to prevent damage to the shafts when inserting or removing clubs from the bag.

With further reference to FIG. 4, the body 12 is shown attached to the frame 20. To attach the body 12 to the frame to provide the golf bag 10, the frame 20 is held upright and the side 92 is positioned to face the rod sections 37, 38 with the top and bottom ends 14, 16 of the body 12 are positioned adjacent the V-shaped top 26 and the V-shaped bottom 28 of the frame, respectively. The garment bag 32, which is hingedly attached as by stitches along its length to an outer edge of the side 92 of the body 12 as shown in FIG. 3, is positioned to encircle the spine (FIG. 2) so that the spine is sandwiched between the garment bag 32 and the side 92. The garment bag is releasably maintained in this position by the mating hook and loop material 35.

The top and bottom ends 14, 16 of the body are attached to the frame by wrapping the cuffs 22, 23 and straps 24 around the V-shaped top 26 and V-shaped bottom 28. To this end, the cuffs 22, 23 are hingedly attached, as by stitches, to the uppermost horizontal edges of the sides 94, 96 at the top end 14 of the bag and are located so that they are adjacent sections 48 and 56 of the V-shaped top 26 of the frame, respectively, when the side 92 is facing the spine 34 as set forth above. The straps 24 are attached, as by thread, at locations on the bottom end 16 of the bag and are located so that they are adjacent sections 74, 82 and elbows 76, 80 of the V-shaped bottom of the frame when the side 92 is facing the spine 34 as set forth above.

Figure 7:
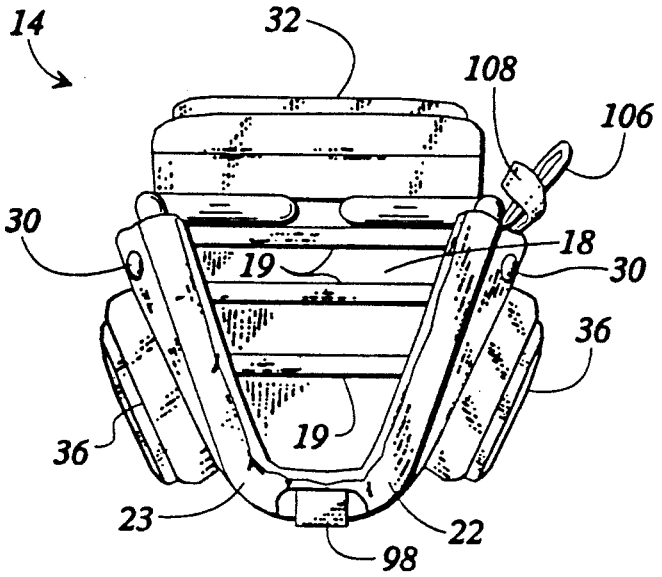
FIG. 7 is a top plan view of the golf bag of FIG. 1.
Figure 8:
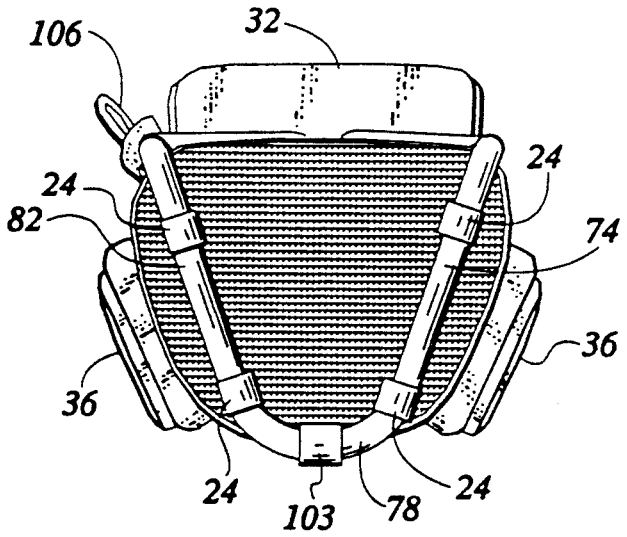
FIG. 8 is a bottom plan view of the golf bag of FIG. 1.

With reference to FIG. 7, the cuffs 22, 23 are shown wrapped around the sections 48, 56 of the V-shaped top 26 of the frame. As mentioned previously, the cuffs 22, 23 are secured in the wrapped Position by mating button snaps 30 provided between the cuffs 22, 23 and the body 12 of the bag and by snap 30*a* connecting the cuffs. FIG. 8 shows the straps 24 wrapped around sections 74, 82 and elbows 76, 80 of the V-shaped bottom of the frame.

The present invention provides a golf bag that is easy to carry because it is light-weight and non-cumbersome. To this end, an upper end 97 of a carrying strap 98 is attached by a hook 100 to loop 102 sewn to a connecting strap 104 and a lower end 103 of the carrying strap 98 is sewn to the bottom of the bag. The connecting strap 104 is preferably sewn to the uppermost edge of the body between the sides 94, 96, and both ends 97, 103 of the strap 98 preferably loop around the top and bottom of the frame, respectively, as best seen in FIGS. 7 and 8. Optionally, a sleeve 106 and cinch belt 108 may be provided adjacent the carrying strap 98 for storage of an umbrella.

The golf bag 10 is constructed of light-weight materials and configured so that the frame 20 does not rub against or bump the body or legs of the golfer when the golfer carries the bag. For example, the spine 34 of the frame is provided by closely spaced and parallel rod sections 37,38 that are positioned near the centerline of the body so that the spine 34 substantially aligns with the central longitudinal axis of the body 12 and not the peripheral edges of the body. This isolates the spine 34 of the frame 20 from contact with the golfer when the bag is carried. The parallel rod sections 37,38 also provide more stability against rotation of the body about the spine than would a spine formed by a single rod section. In addition, the spine is sandwiched between the side 92 of the body and the garment bag to further isolate the spine from direct contact with the golfer.

The curved top and bottom ends of the frame are also isolated from direct contact with the golfer. The strap 98 is located so that the midpoint of the golf bag 10 is adjacent the golfer and the ends of the bag 10 extend away from the golfer when the golf bag is carried.

Furthermore, the cuffs 22, 23 wrap around the top end of the frame and are padded so that any incidental contact, such as when returning clubs to the cavity, is cushioned. The bottom end of the frame is positioned underneath the bottom of the bag and is thus isolated from contact with the golfer.

The foregoing description of a particular embodiment of the present invention has been provided for purposes of illustration only, and it is understood that numerous modifications or alterations may be made without departing from the spirit and scope of the invention as defined in the following claims.

We claim:

1. A gold bag for carrying by a golfer, comprising:

an elongate body having an exterior, an interior, an open upper end having a perimeter, a closed lower end, a width, a length, and a central longitudinal axis, said body defining a cavity along its interior between said upper end and lower end for receiving a plurality of golf clubs;

a rigid frame supportably associated with said body and positioned adjacent to the exterior of said body, said frame comprising:

a top frame portion positioned adjacent said upper end of said body, a bottom frame portion positioned adjacent to said lower end of said body, a spine having first and second longitudinal sides, said spine extending between and connecting said top and bottom portions of said frame and aligned substantially parallel to the length and central longitudinal axis of said body;

means for attaching said body to said frame; and a secondary body portion having a first longitudinal edge opposite a second longitudinal edge, means for hingedly attaching at least a portion of the first longitudinal edge to said elongate body at a first attachment site on said elongate body adjacent the first side of said spine and means for releasably fastening at least a portion of said second longitudinal edge to said elongate body at a second attachment site on said elongate body adjacent the second side of the spine so that said secondary body portion is hingedly positionable around said spine to sandwich said spine between said elongate body and said secondary body portion.

2. The golf bag of claim 1, wherein said top and bottom portions of said frame extend outwardly and generally perpendicularly to said spine.

3. The golf bag of claim 1, wherein said means for attaching said body to said frame comprises cuff means located at the upper end of said body for attaching the upper end of said body to said top frame portion.

4. The golf bag of claim 1, wherein said spine comprises:

a pair of parallel and closely spaced apart spine rod sections such that the distance between said spine rods is substantially less than the width of said elongate body;

wherein said top frame portion is connected to one end of said rod sections;

and said bottom frame portion is connected to the other end of said rod sections, said top and bottom frame portions each comprising:

a pair of diverging extension arms extending laterally away from the spine; and a generally curved portion disposed in a plane substantially perpendicular to said spine and connected to each of said extension arms.

5. The golf bag of claim 1, wherein said spine comprises:

a first spine rod, a second spine rod laterally spaced apart from said first spine rod by a distance substantially less than the width of said elongate body portion and being disposed substantially parallel to said first spine rod, said first and second spine rods defining a spine plane, said first and second spine rods being defined as vertical and as having top ends and bottom ends; wherein said top frame portion comprises:

first and second top diverging extension arms extending from said first and second top ends, respectively, of said spine rods, said first and second top extension arms extending generally upwardly and laterally outwardly from the top ends of said first and second spine rods, being disposed substantially within said spine plane and terminating at first and second upper ends that are spaced apart by a distance approximately equal to the width of said body, and a top curved portion extending from said first upper end to said second upper end and lying in a plane that is substantially perpendicular to the spine plane, said top curved portion having a length approximately equal to the perimeter of the open end of said elongate body less the distance between said upper ends of said diverging arms, said top curved portion being attached to, and defining the shape of, a portion of the perimeter of the open end of said elongate body; and wherein said bottom frame portion comprises:

first and second bottom extension arms extending away from said first and second bottom ends, respectively, of said spine rods, said first and second bottom diverging arms extending generally downwardly and laterally outwardly from the bottom ends of said first and second spine rods, being disposed substantially within said spine plane and terminating at first and second lower ends, and a bottom curved portion extending from said first lower end to said second lower end and lying in a plane that is substantially perpendicular to the spine plane, said bottom curved portion being disposed beneath, for vertically supporting, the closed lower end of said elongate body.

6. The golf bag of claim 5, wherein a portion of the body adjacent the spine rods terminates at a selected position below said top curved portion so that a goalpost shaped opening is defined above the body portion adjacent the spine rods and between the first and second top diverging extension arms for accessing the cavity within the bag.

7. The golf bag of claim 5, further comprising a carrying strap attached to said bag and positioned so that when the bag is lifted, said spine rods remain in a substantially vertical plane and said first and second top diverging extension arms remain in a horizontal plane so that the body of the bag and not the spine rods engage the golfer.

8. The golf bag of claim 7, wherein said body has a pair of lateral sides positioned remote from said spine rods and said strap is attached adjacent said lateral sides to support the bag at a point opposite from the spine rods so that when the bag is lifted by the strap the lateral sides engage the golfer and not the spine rods.

9. A golf bag, comprising an elongate body having an exterior, an interior, an open upper end, a closed lower end, a length, a width and a central longitudinal axis, said body defining a cavity along its interior between said upper end and lower end for receiving a plurality of golf clubs; a rigid frame supportably associated with said body and positioned adjacent to the exterior of said body, said frame comprising a spine having a pair of parallel and closely spaced apart rod sections, a top frame portion connected to one end of said rod sections, a bottom frame portion connected to the other end of said rod sections, said top and bottom frame portion each comprising a pair of diverging extension arms extending laterally away from the spine, and a generally curved portion disposed in a plane substantially perpendicular to said spine and connected to each of said extension arms; a secondary body portion positioned adjacent said spine opposite of said elongate body, said secondary body portion having a first longitudinal edge, means for hingedly attaching said first longitudinal edge to said body and a second longitudinal edge releasably attached to said body by hook and loop material so that said secondary body portion is hingedly positionable around said spine to sandwich said spine between said body and said secondary body portion; cuff means located at the upper end of said body for attaching the upper end of said body to said top frame portion; and attachment means located at the lower end of said body for attaching the lower end of said body to said bottom frame portion.

* * * * *